United States Patent [19]

Cook

[11] Patent Number: 5,050,568

[45] Date of Patent: Sep. 24, 1991

[54] REGULATED FLOW CANISTER PURGE SYSTEM

[75] Inventor: John E. Cook, Chatham, Canada

[73] Assignee: Siemens Automotive Limited, Chatham, Canada

[21] Appl. No.: 591,219

[22] Filed: Oct. 4, 1990

Related U.S. Application Data

[63] Continuation-in-part of Ser. No. 490,791, Mar. 8, 1990, which is a continuation-in-part of Ser. No. 452,664, Dec. 18, 1989, Pat. No. 4,995,369.

[51] Int. Cl.[5] ..... F02M 25/08

[52] U.S. Cl. ..... 123/521; 123/518

[58] Field of Search ..... 123/520, 521, 518, 519, 123/516, 357

[56] References Cited

U.S. PATENT DOCUMENTS

| | | | |
|---|---|---|---|
| 3,575,152 | 4/1971 | Wenworth | 123/520 |
| 4,059,081 | 11/1977 | Kayanuma | 123/521 |
| 4,411,241 | 10/1983 | Ishida | 123/521 |
| 4,646,702 | 3/1987 | Matsubara | 123/520 |
| 4,703,737 | 11/1987 | Cook | 123/518 |
| 4,703,738 | 11/1987 | Deminco | 123/520 |
| 4,763,634 | 8/1988 | Morozumi | 123/520 |
| 4,951,637 | 8/1990 | Cook | 123/520 |
| 4,961,412 | 10/1990 | Furuyama | 123/357 |
| 4,995,369 | 2/1991 | Cook | 123/520 |

FOREIGN PATENT DOCUMENTS

| | | | |
|---|---|---|---|
| 0040243 | 3/1980 | Japan | 123/520 |
| 0029761 | 2/1984 | Japan | 123/520 |

*Primary Examiner*—Carl Stuart Miller

*Attorney, Agent, or Firm*—George L. Boller; Russel C. Wells

[57] ABSTRACT

The evaporative emission control system for an internal combustion engine purges the vapor collection canister to the intake manifold through a purge regulator controlled by the engine ECU. The purge regulator comprises a diaphragm valve and an electronic vacuum regulator. The purge regulator functions to allow a purge flow rate correlated with a control signal from the engine ECU and manifold vacuum, to maintain the purge flow rate substantially constant in response to certain changes in the magnitude of manifold vaccum, and to re-adjust the purge flow rate in correlation with changes in the control signal from the engine ECU.

5 Claims, 5 Drawing Sheets

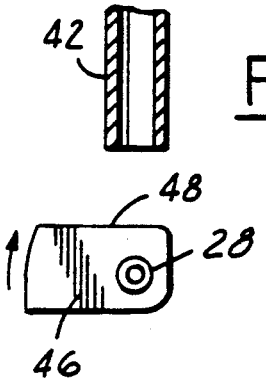
FIG.2
FIG.3
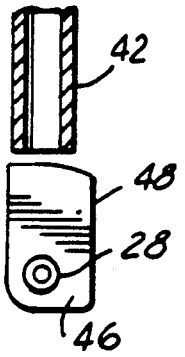
FIG.4
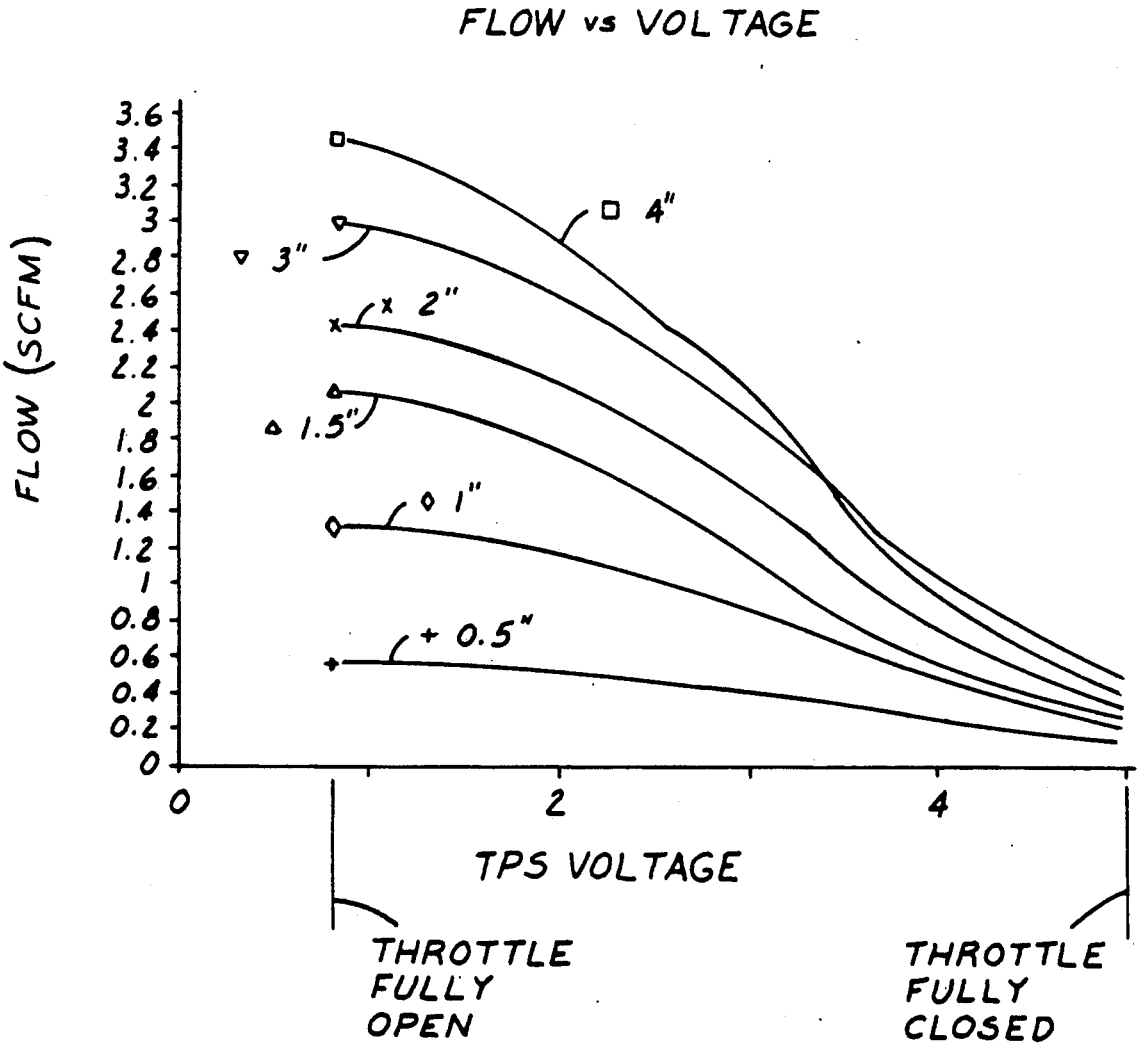

REGULATED FLOW CANISTER PURGE SYSTEM

REFERENCE TO RELATED APPLICATIONS

This application is a continuation-in-part of Ser. No. 07/490,791, filed Mar. 8, 1990, which is a continuation-in-part Ser. No. 07/452,664, filed Dec. 18, 1989, now U.S. Pat. No. 4,995,369.

BACKGROUND AND SUMMARY OF THE INVENTION

This invention relates to evaporative emission control systems of the type that are commonly used in association with internal combustion engines of automotive vehicles.

In such an evaporative emission control system, excess fuel vapors from the fuel tank are collected in a canister which must be periodically purged to the engine's induction system so that the vapors can pass into the engine's cylinders for combustion. In this way, the excess vapors do not escape to atmosphere where they may otherwise contribute to air pollution. The periodic purging of the vapor collection canister is conducted when conditions conducive to purging exist, and therefore it is a customary practice to have a canister purge solenoid (CPS) valve exercise control over the venting of the canister to the induction system and to place the CPS under the control of the engine electronic control unit (ECU). Because the ECU receives signals representing various engine operating parameters, it can be programmed to allow purging of the canister at different rates depending upon the prevailing engine operating conditions. Thus at certain times, greater amounts of purging may be permitted while at others, lesser amounts may be allowed.

Governmental regulations establish limits for the amount of fuel vapor that is permitted to be emitted from an automotive vehicle to atmosphere. The establishment of stricter regulations may impose heavier burdens on evaporative emission control systems such that the present systems may not be able to achieve compliance. Accordingly, there is a need for further improvement in the existing evaporative emission control systems of automotive vehicles so that increased flow rates of excess fuel vapors can be successfully handled without sacrificing low flow rate accuracy. The present invention is directed to a solution for meeting this need.

The first four drawing figures relate to an embodiment which comprises the inclusion of a variable orifice in the vapor flow path from the canister to the induction system and the use of the engine's throttle to exercise control over the degree of restriction imposed by the variable orifice on the vapor flow path to the induction system. The variable orifice is progressively increasingly restricted as the engine is progressively increasingly throttled. A purge regulator that is under the control of the engine ECU also exercises control over the vapor flow to the induction system. The ECU is programmed using conventional programming techniques to produce a desired degree of purge flow regulation in accordance with engine operating conditions detected by the ECU. Thus, certain principles of the invention contemplate the conjoint control of the vapor flow from the canister to the induction system by the throttle's control of the variable orifice and by the ECU's control of the purge regulator.

A modern internal combustion engine that contains an ECU typically has a throttle position sensor that provides to the ECU an indication of the instantaneous throttle position. By having the variable orifice directly controlled by the throttle, the throttle position sensor signal is made inherently representative of the degree of restriction imposed by the variable orifice on vapor flow from the canister to the induction passage. Thus, the ECU can "read" the variable orifice and take that reading into account as it exercises control over the purge regulator.

The invention is well suited for providing controlled canister purging over a large dynamic range extending from engine idle to wide open throttle. It is also capable of providing a steadier flow that is beneficial in attenuating hydrocarbon emission spikes in the engine exhaust.

FIGS. 5 through 9 of the drawings relate to a novel construction for coupling the purge valve with the movable wall (diaphragm) that operates it. A rod that is guided for linear motion has one end connected to the movable wall and the other end to the purge valve. The connection to the movable wall is through a joint that essentially precludes the transmission of any bending moment from the movable wall to the rod. The connection to the valve provides for a certain wobble of the valve head that is advantageous for proper seating on the valve seat while preventing fluid leakage through the connection. The combination of these features enhances the accuracy of response of the device to commands.

The remaining drawing figure relates to an embodiment of purge regulator in which the construction of the vacuum regulator is different from that of the vacuum regulator of FIG. 5.

The foregoing features, advantages, and benefits of the invention, along with additional ones, will be seen in the ensuing description and claims, which should be considered in conjunction with the accompanying drawings. The drawings disclose a presently preferred embodiment of the invention in accordance with the best mode contemplated at this time in carrying out the invention.

BRIEF DESCRIPTION OF THE DRAWINGS

FIG. 2 is a view looking in the direction of arrows 2—2 in FIG. 1.

FIG. 3 is a view similar to FIG. 2, but illustrating another position of operation.

FIG. 4 is a graph plot of actual test flow data useful in explaining certain principles of the invention.

DESCRIPTION OF THE PREFERRED EMBODIMENT

Figure 1:
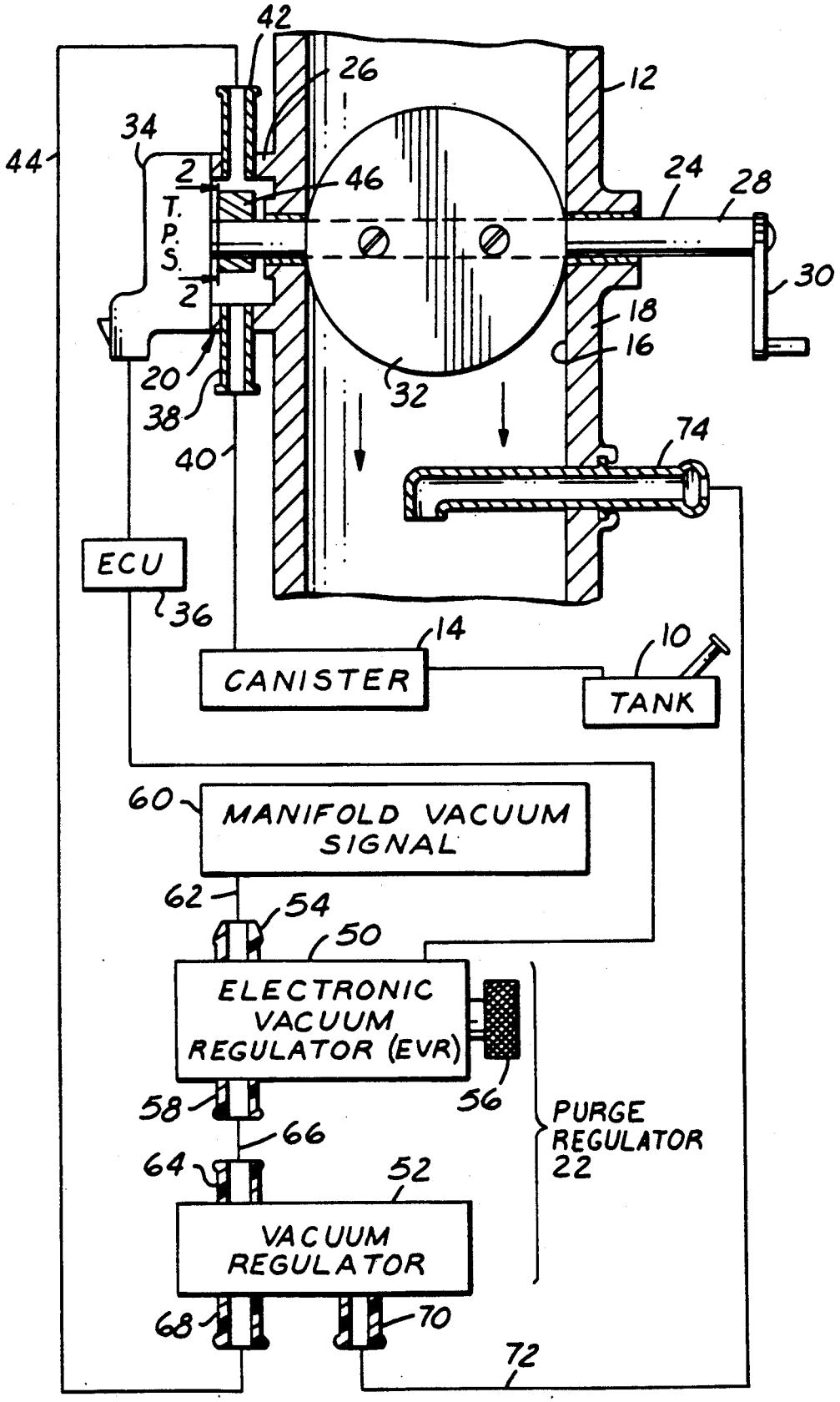
FIG. 1 is a schematic diagram presenting the presently preferred embodiment of regulated flow canister purge system according to the present invention.

An automotive vehicle that is powered by an internal combustion engine includes a fuel tank 10 and a throttle assembly 12. Excess fuel vapors that are vented from tank 10 are collected in a canister 14. The collected vapors are exhausted from canister 14 to the air induction passage 16 that passes through the body 18 of throttle assembly 12 with the passage of the vapors being under the conjoint control of a variable orifice valve 20 and a purge regulator 22.

Variable orifice valve 20 is operated directly by the throttle mechanism 24 of throttle assembly 12. Valve 20 comprises a body 26 that is fixedly mounted on the outside wall of throttle body 18.

Throttle mechanism 24 comprises a shaft 28 that is arranged perpendicular to the direction of induction air flow through passage 16 and is journaled for rotation on the throttle body. Shaft 28 is operated by a crank 30 that is linked to the vehicle accelerator pedal (not shown). A throttle blade, or butterfly, 32 is fastened to shaft 28 within passage 16 The extent to which shaft 28 is operated by crank 30 determines the position of butterfly 32 within passage 16 and hence the degree of throttling of the engine.

The end of shaft 28 opposite crank 30 passes through body 26 to operate a throttle position sensor (TPS) 34 that is disposed outboard of variable orifice valve 20. TPS 34 is one of a number of inputs to an engine electronic control unit (ECU) 36, the other inputs to the ECU not appearing in FIG. 1. TPS 34 provides to ECU 36 an electrical signal indicative of the instantaneous throttle position.

ECU 36 controls a number of engine operating functions, such as fuel, spark, etc. It also exercises control over purge regulator 22.

Details of variable orifice valve 20 include an inlet nipple 38 providing for the connection of a hose 40 from canister 14 and an outlet nipple 42 providing for connection of a hose 44 to purge regulator 22. Disposed within the interior of valve body 26 and affixed to shaft 28 is a valving member in the form of a rotary cam 46.

As shown in FIGS. 2 and 3, cam 46 has a profile 48 that is adapted to coact with the interior end of nipple 42 as the throttle shaft rotates thereby providing a variable restriction. FIG. 1 shows throttle blade 32 in essentially the wide open throttle position, and the corresponding position portrayed by FIG. 2 represents the minimum restriction position of the variable orifice valve.

As the throttle is progressively operated from the wide open throttle position toward engine idle position, cam 46 rotates in the clockwise sense as viewed in FIG. 2 to progressively increasingly restrict the variable orifice. At engine idle, as represented by FIG. 3, the variable orifice imposes maximum restriction to flow from canister 14. Since TPS 34 is being concurrently operated with cam 46, the TPS signal to ECU 36 is inherently representative of the degree of restriction being imposed by the variable orifice valve on vapor flow from the canister. In this way, the ECU can "read" the TPS to determine the restriction being imposed on the flow from the canister.

Purge regulator 22 may be considered to comprise two conventional components, namely an electronic vacuum regulator (EVR) 50 and a vacuum regulator 52. A device like that described in commonly assigned U.S. Pat. No. 4,850,384 is suitable for EVR 50. The EVR has a vacuum inlet nipple 54, an atmospheric vent 56, and a vacuum outlet nipple 58. Nipple 54 is connected to a vacuum signal source, namely engine manifold vacuum 60, by a hose 62. The EVR contains a solenoid that is pulse width modulated by ECU 36. In this way the vacuum level that appears at nipple 58 is controlled by ECU 36.

Vacuum regulator 52 comprises a control nipple 64 that is connected to nipple 58 by a hose 66. It also has an inlet nipple 68 to which hose 44 is connected and an outlet nipple 70 connected by a hose 72 to a nipple 74 that extends through the wall of throttle body 18 at a location downstream of throttle blade 32. Vacuum regulator 52 is responsive to the vacuum output of EVR 50 to regulate the flow through the vacuum regulator from nipple 68 to nipple 70. The larger the vacuum delivered to nipple 64, the more flow is permitted from nipple 68 to nipple 70, and the smaller the vacuum delivered to nipple 64, the less flow is permitted from nipple 68 to nipple 70. And so it can be appreciated that the vapor flow that is permitted by purge regulator 22 is under the control of ECU 36.

Accordingly, it can be further appreciated that the vapor flow from canister 14 to induction passage 16 is a function both of the throttle position as the throttle shaft controls variable orifice valve 20, and of the degree to which ECU 36 permits flow through purge regulator 22.

The effect of variable orifice valve 20 on the canister purge process can be nicely explained with reference to FIG. 4. For a given pressure drop across the valve, there exists a corresponding graph plot that charts the flow rate through the valve as a function of throttle blade position. FIG. 4 presents, by way of example, a series of six individual graph plots, each of which corresponds to a specific pressure drop across the variable orifice valve 20. The pressure drops that are represented in FIG. 4 are, in terms of inches of mercury (Hg), 0.5 inch, 1.0 inch, 1.5 inches, 2.0 inches, 3.0 inches, 4.0 inches. For a given pressure drop, the corresponding graph plot depicts the flow rate through the variable orifice valve 20 as a function of the amount of throttle blade opening between fully open and closed throttle conditions. Stated another way, for a given throttle position, the flow vs. pressure drop characteristic is defined for valve 20. Because the throttle position sensor provides the ECU with the capability of reading the variable orifice, suitable mapping of the ECU such as in the exemplary manner of FIG. 4 enables the ECU to know the corresponding flow vs. pressure drop characteristic of variable orifice valve 20 for specific throttle blade positions. The ECU can then take this into account when setting purge regulator 22.

The provision of the variable orifice valve 20 under the control of the throttle endows the emission control system with a wide dynamic range, allowing good control from engine idle to wide open throttle. As a result, the system can achieve compliance with stricter evaporative emission standards. The solenoid of EVR 50 is operated by a frequency of signal from the ECU which is considerably higher than that used to control previously used CPS valves. (125–150 hz vs 10–20 hz, typically). This serves to attenuate hydrocarbon spikes in exhaust emission.

FIGS. 5–9 present details of a purge regulator 80. It comprises an EVR 82 and a vacuum regulator 84. Although the illustrated purge regulator embodies the EVR and the vacuum regulator in a single unit, they could be embodied as two separate devices with a suitable connection from the EVR to the vacuum regulator.

EVR 82 is essentially conventional, comprising a vacuum inlet 86 to which vacuum is supplied and an outlet 88 at which a percentage of the vacuum is delivered, as determined by an electrical control signal supplied to an electrical input 90. The vacuum from outlet 88 is supplied as an input to vacuum regulator 84.

Vacuum regulator 84 may be considered to comprise an actuator portion 92 and a valve portion 94. Actuator portion 92 comprises a movable interior wall 95 that divides two variable volume chamber spaces 96 and 98 whose respective volumes establish the position of movable wall 95. Regulated vacuum from outlet 88 is supplied to chamber space 96. Chamber space 98 is in communication with the fuel vapor storage canister via valve portion 94.

Figure 5:
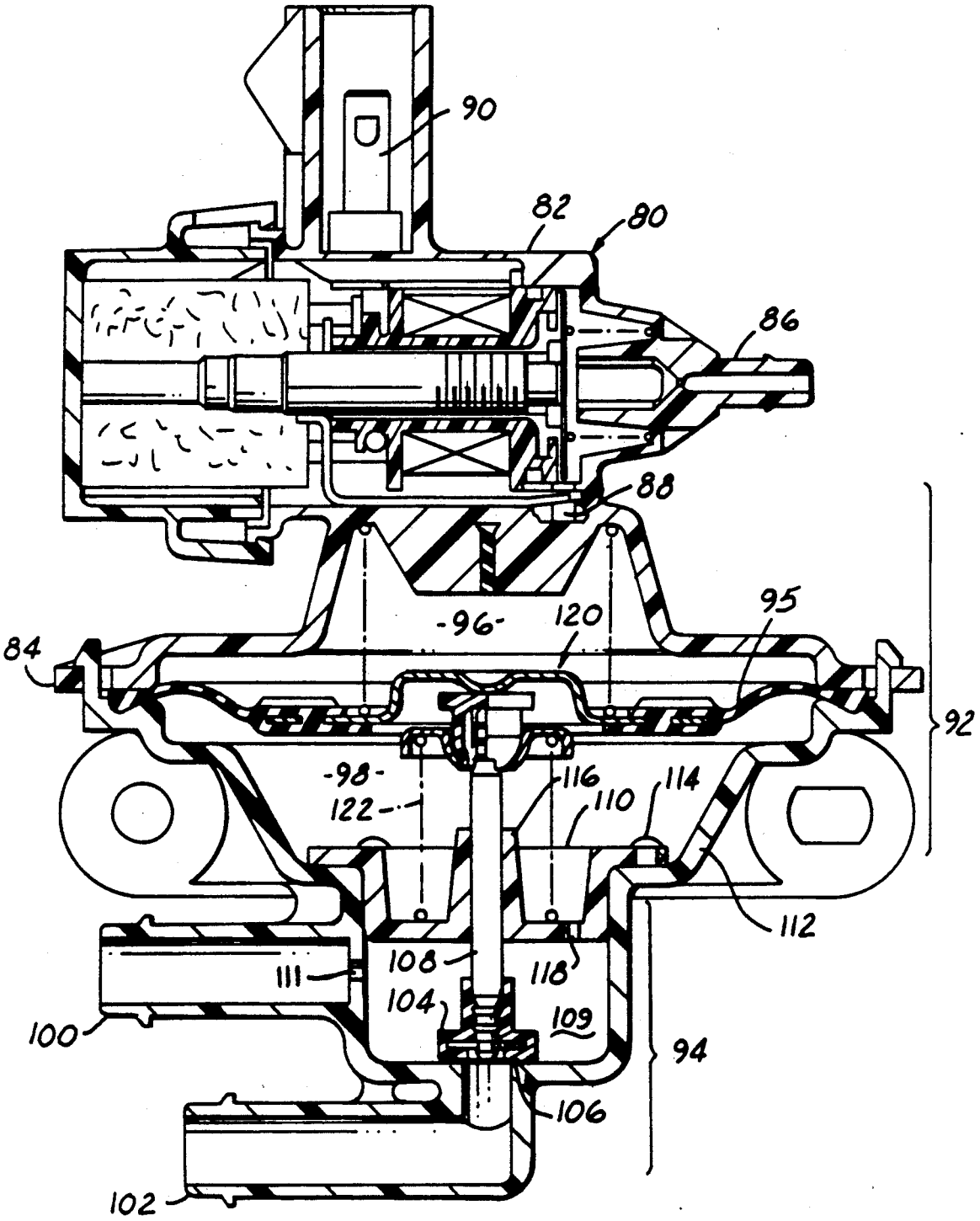
FIG. 5 is a cross section through a preferred embodiment of valve.
Figure 6:
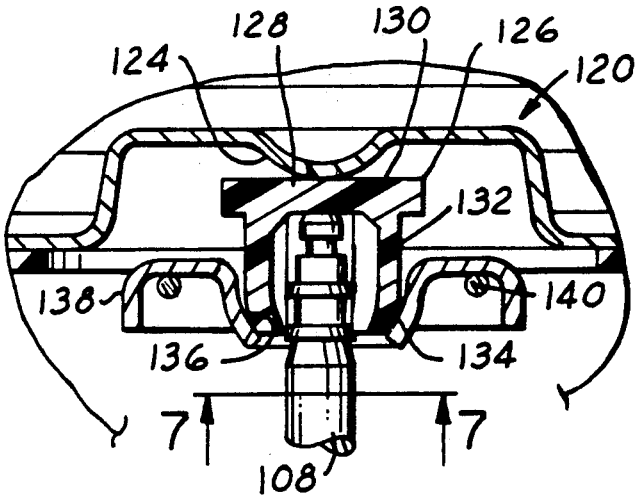
FIG. 6 is an enlarged fragmentary view of a portion of FIG. 5.
Figure 7:
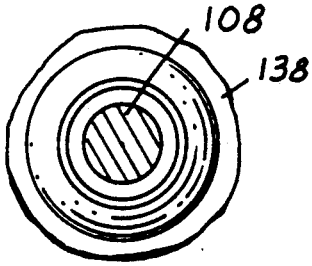
FIG. 7 is a transverse cross section taken in the direction of arrows 7—7 in FIG. 6.
Figure 8:
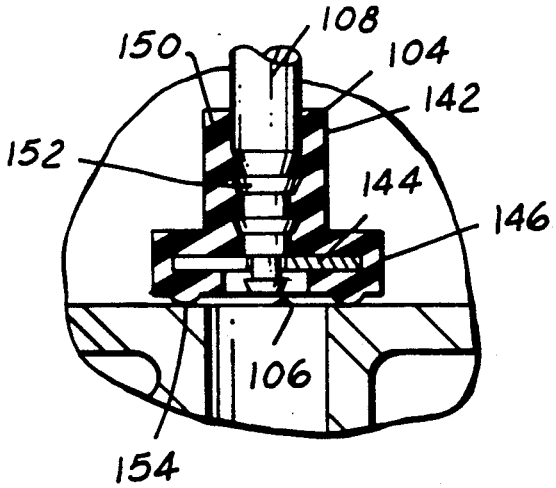
FIG. 8 is an enlarged fragmentary view of a portion of FIG. 6.

Valve portion 94 comprises an inlet nipple 100 via which it is placed in communication with the fuel vapor storage canister, and an outlet nipple 102 via which it is placed in communication with the engine intake manifold. A valve 104 that is operated by actuator portion 92 controls communication through valve portion 94 between inlet nipple 100 and outlet nipple 102. FIGS. 5 and 8 show valve 104 in seated position on a valve seat 106 preventing flow from nipple 100 to nipple 102.

Valve 104 is coupled to movable wall 95 by means that includes a straight circular cylindrical rod 108. Rod 108 is guided for straight-line motion toward and away from valve seat 106 by means of an annular guide member 110 which is secured to the housing 112 by any suitable means such as 114. Guide member 110 comprises a cylindrical sleeve 116 which is co-axial with both movable wall 94 and valve seat 106 and through which the central portion of rod 108 passes. Guide member 110 also comprises a hole 118 which serves to communicate chamber space 98 with whatever pressure or vacuum may occur on the canister side of valve 104. Hole 118 is an orifice which is sized to control the rate at which flow can pass between chamber space 98 and the space 109 within which valve 104 is disposed. The net result is the imposition of a damping force on movable wall 95 which serves to prevent valve fluttering that might otherwise occur in response to rapidly occurring changes in pressure differential across the orifice (i.e. between chamber space 98 and space 109). The orifice effect may also have a tendency toward linearizing the response of the vacuum regulator.

It is also to be observed that FIG. 5 shows the presence of a fixed orifice 111 in the wall between nipple 100 and space 109. Orifice 111 is effective to ensure that the magnitude of vacuum in space 109 at least approximates the engine manifold vacuum, while also establishing an upper limit for the flow rate through the vacuum regulator. Orifice 111 may be present either with or without a co-operative association of purge regulator 80 with a variable orifice valve, like valve 20 of FIGS. 1–4. Any given configuration of a regulated flow canister purge system will of course be designed for compliance with a defined engineering specification, and hence one configuration may comprise a variable orifice valve, another, a variable orifice valve connected to a purge regulator (with or without fixed orifice), another only a purge regulator with an orifice.

A purge regulator can be designed to service different requirements without major modification. Rather than making the purge regulator of FIG. 5 to have an integral fixed orifice, the purge regulator can be constructed to have the opening between space 109 and nipple 100 equal to the cross-sectional area of nipples 100,102, and adopting the nipple to receive an inserted orifice disc. Such an orifice disc will close most of the nipple except for an orifice in the disc. The area of the orifice in any given orifice disc may be selected as required for the particular system into which the purge regulator is to be installed.

The end of rod 108 that is opposite the end containing valve 104 is coupled with movable wall 95 by means of a joint 120 that is designed so as to be incapable of transmitting any significant bending moment from movable wall 95, through the rod, to the valve. This attribute is important because the action of movable wall 95 on the rod might otherwise impart a bending moment which could adversely affect rod displacement and hence impair the accuracy of the rod's positioning of valve 104. A principal cause of the tendency of movable wall 95 to impart a bending moment to rod 108 is due to the fact that the wall is resiliently biased by a helical coil spring 122 in a sense that urges valve 104 toward seating on seat 106, and the force distribution acting on the movable wall is not circumferentially uniform. Hence, the movable wall has a tendency to tilt, or cock about its axis, but adverse consequences of this tendency are avoided because of the provision of joint 120.

Joint 120 comprises a spherically contoured surface 124 in movable wall 95 acting through an element 126 on the end of rod 108. Element 126 comprises a head 128 having on one side a flat surface 130 against which surface 124 is in tangential contact. A cylindrical annular shank 132 extends from the opposite side of head 128 and is united to the rod end by an interference-fit therewith. The distal end of shank 132 is rounded at 134 for seating in a complementary rounded depression 136 in an annular member 138. The outer margin of member 138 is shaped to form a seat for one end of a further helical coil spring 140 that is disposed between member 138 and member 110, the latter having a spring seat for the opposite end of the spring. Spring 140 functions to keep the surface 130 of head 128 against surface 124 (i.e., capture element 126 between wall 95 and member 138) as the movable wall is positioned within the housing 112. The rounded fitting of member 138 to the distal end of shank 132 prevents spring 140 from transmitting any significant bending moment to the joint.

Figure 9:
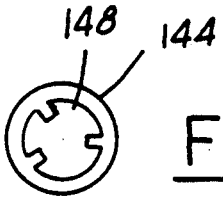
FIG. 9 is a plan view of one of the parts of FIG. 8 shown by itself.

FIGS. 5, 8, and 9 present details of valve 104 and its attachment to rod Valve 104 comprises an elastomeric part 142 and a relatively more rigid metal part 144. Part 144 is a circular metal disc that is disposed interiorly of an annular head 146 of elastomeric part 142. Part 144 has an aperture 148 of the shape illustrated in FIG. 9 that provides for attachment of the part to rod 108 in such a manner that it can wobble to a certain extent on the rod. Part 142 further comprises an annular sleeve 150 extending from head 146 and seals the valve to the rod. The rod end is shown to have axially spaced circular serrations 152 that aid in the sealing and retention of the head on the rod end. Head 146 also contains a circular ridge 154 for sealing contact with valve seat 106. The design of valve 104 is beneficial in attaining proper sealing, especially in mass production usage, because the head can self-adjust to the seat while sealing of the valve to the rod end is assured.

The device operates in the following manner. Movable wall 95 is axially positioned in accordance with the pressure differential between the two chamber spaces 96, 98. Since a controlled percentage of manifold vacuum is applied to chamber space 96, the relative volumes of the two chamber spaces and hence the position of wall 95 are related to the percentage manifold vacuum applied to the vacuum regulator from the EVR. This will produce a corresponding positioning of valve 104 to control the flow of vapor from the canister to the manifold. In this way the purging of the canister is regulated to occur during conditions of engine operation that are conducive to purging.

Figure 10:
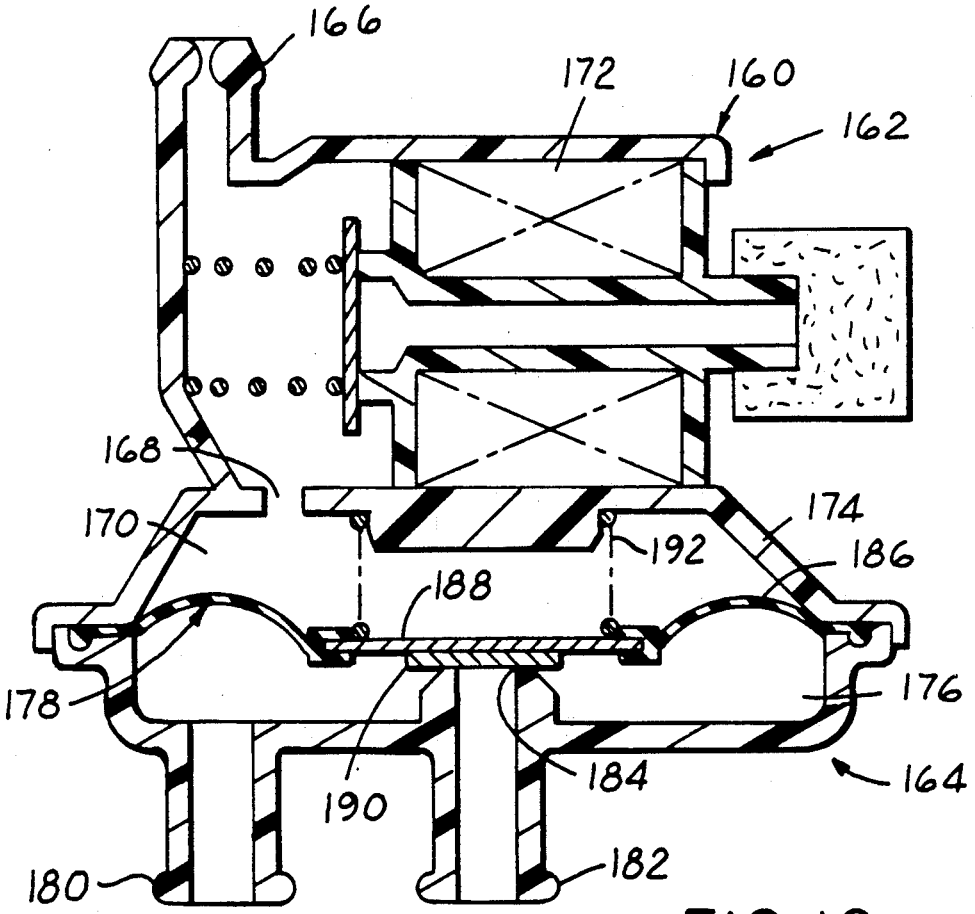
FIG. 10 is a cross section through another embodiment of valve.

FIG. 10 shows a purge regulator 160 comprising an EVR 162 and a vacuum regulator 164. EVR 162 is essentially like EVR 82, comprising a vacuum inlet 166 for connection to manifold vacuum and an outlet 168 that is communicated to a chamber space 170 of vacuum regulator 164 corresponding to the chamber space 96 of vacuum regulator 84. The vacuum that is delivered to chamber space 170 from EVR 162 is a percentage of the vacuum input at inlet 166 as determined by an electrical control signal supplied to the EVR's solenoid 172.

Vacuum regulator 164 comprises a housing 174 that is divided into two chamber spaces 170, 176 by a movable wall 178. Housing 174 has an inlet nipple 180 and an outlet nipple 182. The inlet nipple is open to chamber space 176. A valve seat 184 is fashioned within chamber space 176 around outlet nipple 182.

Wall 178 comprises an outer annular part 186, and a rigid central part 188. The face of part 188 which is toward seat 184 contains a valve member in the general form of a circular disc 190. A helical coil spring 192 which is disposed in chamber space 170 bears against part 188 to resiliently urge disc 190 into seating on seat 184 so that chamber space 176 is closed to outlet nipple 182. Although not shown in FIG. 10, it should be understood that there is a suitable orifice between chamber space 176 and the canister so that the vacuum in chamber space 176 at least approximates manifold vacuum.

Purge regulator 160 operates as follows. A percentage of manifold vacuum is delivered to chamber space 170. When the vacuum in that chamber space rises to a certain magnitude, the bias of spring 192 is overcome, and disc 190 unseats from seat 184 to allow flow from the canister through the vacuum regulator to the manifold. Concurrently, the vacuum magnitude in chamber space 176 begins to rise. In a steady state condition, there will be a regulated balance between the two chamber spaces that creates a certain size orifice between disc 190 and seat 184, and hence a corresponding flow rate between the canister and manifold. If the manifold vacuum changes and the control signal from the ECU remains constant, then the resulting change in force caused by the change in vacuum within chamber space 176 will act upon moveable wall 178 causing the relationship between disc 190 and seat 184 to adjust until there is a regulated balance between chambers 170 and 176. The newly established relationship between the disc and seat will adjust the flow from the canister to the intake manifold so that it is essentially the same flow prior to the increase in manifold vacuum. In this manner the purge regulator maintains a constant flow from the canister to the intake manifold when the intake manifold vacuum changes.

For example, when the intake manifold vacuum increases there would normally be an associated increase of flow between the canister and intake manifold. However, the increased force caused by the vacuum will act upon moveable wall 178 and disc 190 causing them to move in an axial direction towards seat 184. As the spacing between the disc and seat is reduced it will impose an increased restriction to flow through regulator 164. The restriction to flow will continue to increase until it causes the vacuum (and resulting force) within chamber 176 to drop to a level that will provide a regulated balance with the vacuum and the bias spring (and resulting force) in chamber 170. When this regulating condition is achieved the relationship between the disc and seat within regulator 164 will provide a flow between the canister and intake manifold that is relatively unchanged from the level of flow prior to the change of intake manifold vacuum.

If on the other hand, the manifold vacuum remains constant and the control signal from the ECU changes, then the electronic vacuum regulator will change the level of vacuum within chamber space 170. The resulting change in force will act in conjunction with the force of bias spring 192 on moveable wall 178 causing the relationship between disc 190 and seat 184 to adjust until there is a new regulated balance between chambers 170 and 176. The newly established relationship between the disc and seat will provide a change in flow from the canister to the intake manifold that is relative to the percentage change in the control signal from the ECU. In this manner an electrical signal can provide control over the flow through the purge regulator.

For example, when the percentage of electrical control signal to the purge regulator is decreased the EVR reduces the level of vacuum in chamber space 170. The reduction of vacuum and hence force acting on moveable wall 178 will allow the force of bias spring 192 working in conjunction with the resulting force of the vacuum in chamber 176 to move disc 190 and moveable wall 178 in an axial direction towards seat 184. As the spacing between the disc and seat is reduced it will impose an increased restriction to flow through regulator 164. The restriction to flow will continue to increase until it causes the vacuum (and resulting force) within chamber 176 to drop to a level that will provide a regulated balance with the vacuum and the bias spring (and resulting force) in chamber 170. When this regulating condition is achieved the relationship between the disc and seat within regulator 164 will provide a lower regulated flow between the canister and intake manifold that is relative to the control signal applied to the purge regulator.

Accordingly, purge regulator 160 performs in like manner to purge regulator 80, but it may possess a somewhat larger tolerance on regulation. Such increased tolerance may be acceptable in certain canister purge systems, and hence purge regulator 160 offers a less costly alternative to purge regulator 80 for such uses.

The invention can therefore be seen to constitute an improvement in evaporative emission control systems. While a presently preferred embodiment of the invention has been illustrated and described, it will be appreciated that principles are applicable to other equivalent embodiments within the scope of the following claims.

What is claimed is:

1. For controlling the purging of a fuel vapor collection canister of an evaporative emission control system associated with the fuel system of an internal combustion engine, a regulated flow canister purge arrangement comprising an electronic vacuum regulator having a vacuum inlet at which engine manifold vacuum is received, an outlet at which is delivered a percentage of the engine manifold vacuum received at the vacuum inlet as determined by an electronic control signal supplied to a control input of the electronic vacuum regulator, a canister purge inlet to which a canister that is to be purged of gaseous fuel vapors is communicated, a canister purge outlet that is communicated to engine manifold vacuum, valve means for controlling flow between said canister purge inlet and said canister purge outlet, and a movable wall for operating said valve means, one side of said movable wall bounding one variable volume chamber and another side of said movable wall bounding another variable volume chamber, biasing means acting on said movable wall so as to cause said valve means to be biased toward blocking flow between said canister purge inlet and said canister purge outlet, and means communicating the outlet of said electronic vacuum regulator with said one variable volume chamber to cause the volumes of said chambers to vary in relation to the percentage of manifold vacuum applied to said one variable volume chamber, characterized in that: vacuum in said another variable volume chamber is caused to be correlated in a predetermined manner with engine manifold vacuum; in that in steady state operating conditions wherein the magnitude of intake manifold vacuum and the value of said control signal are held constant, said valve means operates to allow a corresponding, substantially constant flow rate from said canister purge inlet to said canister purge outlet that is correlated with the intake manifold vacuum and control signal values; in that for a certain steady state value of intake manifold vacuum and a certain steady state value of said control signal, said valve means operates to allow a certain corresponding flow rate from said canister purge inlet to said canister purge outlet; in that in response to a change in intake manifold vacuum from said certain steady state value thereof while said control signal remains unchanged at said certain steady state value thereof, said valve means is re-adjusted such that the flow rate between said canister purge inlet and said canister purge outlet is allowed to continue substantially unchanged at said certain flow rate; and in that in response to a change in said control signal from said steady state value thereof while the magnitude of intake manifold vacuum remains unchanged at said steady state value thereof, said valve means is re-adjusted such that the flow rate between said canister purge inlet and said canister purge outlet is changed from said certain flow rate to an amount correlated with the change in said control signal.

2. A regulated flow canister purge arrangement as set forth in claim 1 characterized further in that vacuum in said another variable volume chamber is caused to be correlated with engine manifold vacuum such that the magnitude of vacuum in said another variable volume chamber is caused to correspond at least approximately to the magnitude of intake manifold vacuum.

3. A regulated flow canister purge arrangement as set forth in claim 1 characterized further in that said another variable volume chamber is communicated with said valve means via an orifice means which is effective to control the rate at which the magnitude of vacuum can build and decay in said another variable volume chamber.

4. A regulated canister purge arrangement as set forth in claim 1 characterized further in that said valve means comprises a disc disposed on said movable wall centrally within said another variable volume chamber so as to be movable with said movable wall and a valve seat disposed within said another variable volume chamber to be opened and closed by said disc in accordance with the position of said movable wall.

5. A regulated canister purge arrangement as set forth in claim characterized further in that said biasing means comprises a helical coil spring.

* * * * *